US009841204B2

(12) United States Patent
Ogawa et al.

(10) Patent No.: US 9,841,204 B2
(45) Date of Patent: Dec. 12, 2017

(54) AIR CONDITIONING CONTROL SYSTEM AND AIR CONDITIONING CONTROL METHOD

(71) Applicant: FUJITSU LIMITED, Kawasaki-shi, Kanagawa (JP)

(72) Inventors: Masatoshi Ogawa, Isehara (JP); Hiroshi Endo, Isehara (JP); Hiroyuki Fukuda, Ebina (JP); Masao Kondo, Sagamihara (JP)

(73) Assignee: FUJITSU LIMITED, Kawasaki (JP)

( * ) Notice: Subject to any disclaimer, the term of this patent is extended or adjusted under 35 U.S.C. 154(b) by 349 days.

(21) Appl. No.: 14/580,775

(22) Filed: Dec. 23, 2014

(65) Prior Publication Data

US 2015/0241077 A1 Aug. 27, 2015

(30) Foreign Application Priority Data

Feb. 27, 2014 (JP) ..... 2014-037024

(51) Int. Cl.
*F24F 11/00* (2006.01)
*G05B 13/02* (2006.01)

(52) U.S. Cl.
CPC ..... *F24F 11/006* (2013.01); *F24F 11/0012* (2013.01); *F24F 11/0015* (2013.01); *F24F 2011/0006* (2013.01)

(58) Field of Classification Search
CPC .. F24F 11/006; F24F 11/0012; F24F 11/0015; F24F 2011/0006

(Continued)

(56) References Cited

U.S. PATENT DOCUMENTS 8,346,398 B2 * 1/2013 Ahmed ..... G06F 1/206 700/278
8,467,905 B2 * 6/2013 George ..... G05D 22/02 236/44 C (Continued)

FOREIGN PATENT DOCUMENTS

JP 2007-139212 6/2007
JP 2011-127812 6/2011

(Continued)

OTHER PUBLICATIONS

JPOA—Office Action dated Aug. 1, 2017 for corresponding to Japanese Patent Application No. 2014-037024, with full machine translation of the Office Action.  Reference JP2013-92298 cited in the JPOA was previously submitted in the IDS filed on Dec. 23, 2014.

*Primary Examiner* — Christopher E Everett
*Assistant Examiner* — Yuhui R Pan
(74) *Attorney, Agent, or Firm* — Fujitsu Patent Center

(57) ABSTRACT

A disclosed air conditioning control system includes: a flow path through which cooling air discharged from an exhaust surface of an electronic apparatus is returned to an intake surface thereof, a damper provided in the flow path, a temperature measuring unit for measuring the real temperature of the cooling air, a humidity measuring unit for measuring the real humidity of the cooling air, a target value changing unit for changing target temperature and humidity in accordance with the real temperature and humidity, and a controlling unit for predicting future predicted values of the real temperature and humidity, and controlling the opening extent of the damper such that the predicted temperature and humidity become close to the target temperature and humidity, respectively. The target value changing unit sets the target temperature and humidity such that the real tempera- (Continued)

ture and humidity are raised and lowered in the opposite directions.

7 Claims, 11 Drawing Sheets

(58) Field of Classification Search
USPC ..... 700/276
See application file for complete search history.

(56) References Cited

U.S. PATENT DOCUMENTS

| | | | | |
|---|---|---|---|---|
| 2011/0186643 | A1 | 8/2011 | Dazai | |
| 2013/0098597 | A1 | 4/2013 | Fujimoto et al. | |
| 2013/0299157 | A1* | 11/2013 | Murayama ..... | H05K 7/20745 165/224 |

FOREIGN PATENT DOCUMENTS

| | | |
|---|---|---|
| JP | 2011-158219 | 8/2011 |
| JP | 2013-092298 | 5/2013 |

* cited by examiner

AIR CONDITIONING CONTROL SYSTEM AND AIR CONDITIONING CONTROL METHOD

CROSS-REFERENCE TO RELATED APPLICATION

This application is based upon and claims the benefit of priority of the prior Japanese Patent Application No. 2014-37024, filed on Feb. 27, 2014, the entire contents of which are incorporated herein by reference.

FIELD

The embodiment discussed herein is related to an air conditioning control system and an air conditioning control method.

BACKGROUND

In datacenters, jobs are distributed to a plurality of electronic apparatuses such as servers, and each electronic apparatus executes its jobs. Each electronic apparatus is provided with a heat generating component such as a central processing unit (CPU). When processing a large amount of jobs, the CPU temperature rises, which may result in failure of the electronic apparatus or deterioration in the performance thereof.

To prevent such rise in CPU temperature, datacenters are provided with mechanisms to cool their electronic apparatuses. Among them, module-type datacenters configured to take in external air as cooling air are effective in terms of energy saving since they have no heat exchanger for cooling the external air.

In such a module-type datacenter, warm cooling air discharged from the exhaust surface of each electronic apparatus is sent back to the intake surface of each electronic apparatus. In this way, it is possible to prevent excessive cooling of the electronic apparatus during the winter season, for example. Moreover, by supplying the warm cooling air to the intake surface of the electronic apparatus in this manner, the humidity around the intake surface can be adjusted as well.

However, there is still room for improvement in module-type datacenters for further energy saving.

Note that a technology related to this application is disclosed in Japanese Laid-open Patent Publication No. 2013-92298.

SUMMARY

According to one aspect discussed herein, there is provided an air conditioning control system, including an electronic apparatus having an intake surface from which cooling air is taken in and an exhaust surface from which the cooling air is discharged, a flow path through which the cooling air discharged from the exhaust surface is returned to the intake surface, a damper which is provided in the flow path, an opening extent of the damper being adjustable, a temperature measuring unit that measures a real temperature of the cooling air at the intake surface, a humidity measuring unit that measures a real humidity of the cooling air at the intake surface, a target value changing unit that changes a target temperature of the real temperature in accordance with a value of the real temperature, and also changes a target humidity of the real humidity in accordance with a value of the real humidity, and a controlling unit that predicts a predicted temperature of the real temperature in a future and a predicted humidity of the real humidity in the future, where the controlling unit controlling the opening extent of the damper such that the predicted temperature becomes close to the target temperature and a predicted humidity becomes close to the target humidity, wherein the target value changing unit sets the target temperature and the target humidity such that the real temperature and the real humidity are raised and lowered in opposite directions.

According to another aspect discussed herein, there is provided an air conditioning control method, the method including measuring, by a temperature measuring unit, a real temperature of cooling air that is taken into an electronic apparatus from an intake surface of the electronic apparatus, measuring, by a humidity measuring unit, a real humidity of the cooling air, changing, by a target value changing unit, a target temperature of the real temperature in accordance with a value of the real temperature, and changing a target humidity of the real humidity in accordance with a value of the real humidity, and adjusting, by a control unit, an opening extent of a damper provided in a flow path through which the cooling air discharged from an exhaust surface of the electronic apparatus is returned to the intake surface, where the opening extent being adjusted, by predicting a predicted temperature of the real temperature in a future and a predicted humidity of the real humidity in the future, such that the predicted temperature becomes close to the target temperature and the predicted humidity becomes close to the target humidity, wherein in the changing the target temperature and the target humidity, the target value changing unit sets the target temperature and the target humidity such that the real temperature and the real humidity are raised and lowered in opposite directions.

The object and advantages of the invention will be realized and attained by means of the elements and combinations particularly pointed out in the claim.

It is to be understood that both the forgoing general description and the following detailed description are exemplary and explanatory and are not restrictive of the invention.

DESCRIPTION OF EMBODIMENT

Prior to describing an embodiment, matters that the inventor of this application considered will be described.

Figure 1:
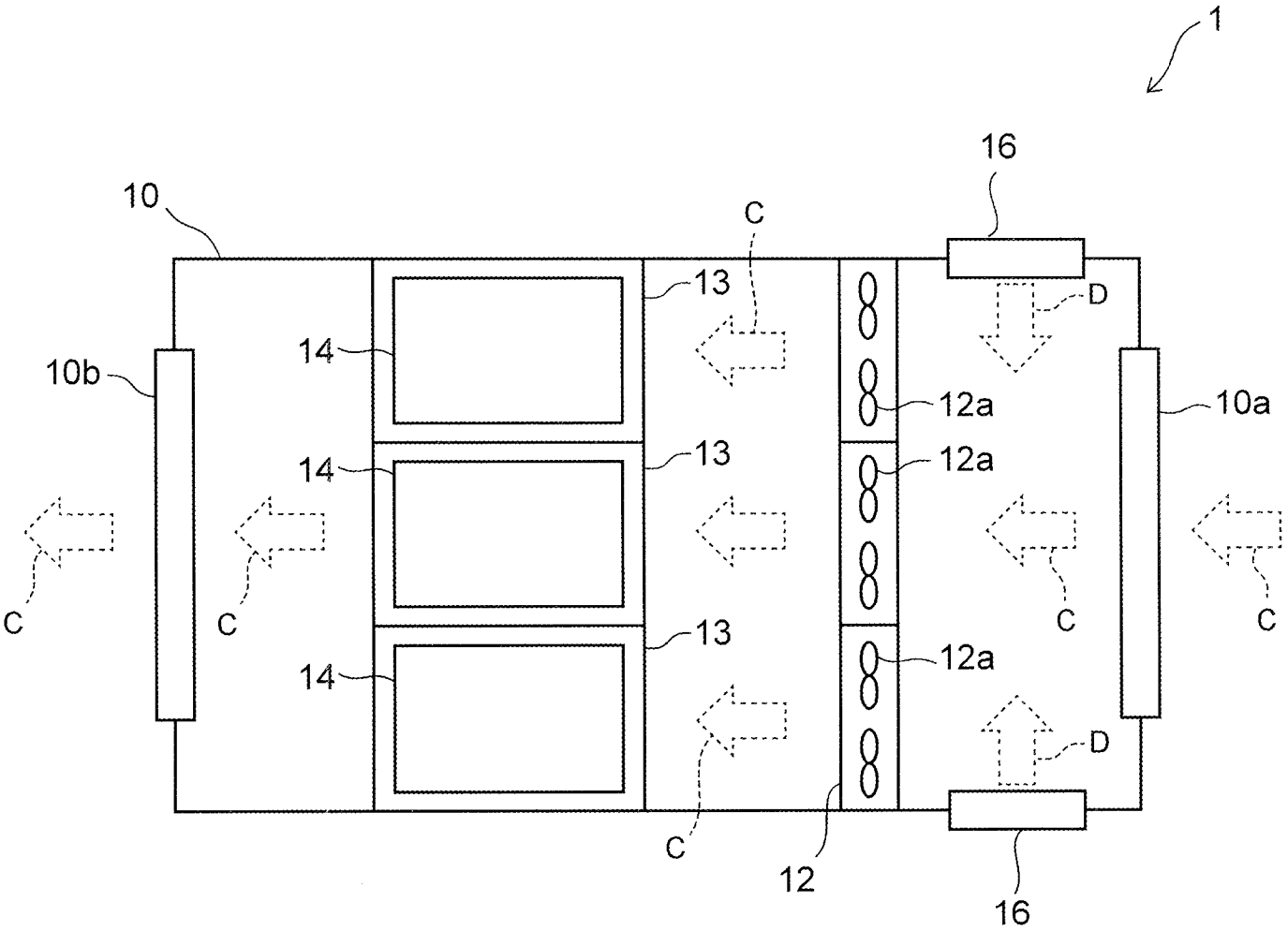
FIG. 1 is a schematic top view of a datacenter used for consideration.

FIG. 1 is a schematic top view of a datacenter used for that consideration.

This datacenter 1 is a module-type datacenter configured to taken in external air as cooling air, and includes a cuboidal container 10.

In the container 10, there are provided a fan unit 12 and a plurality of racks 13 housing electronic apparatuses 14 such as servers.

Among the two opposite faces of the container 10, an air intake opening 10*a* is provided at one face, while an air exhaust opening 10*b* is provided at the other face.

The fan unit 12 includes a plurality of fans 12*a*. By rotating the fans 12*a*, the fans 12*a* take external air into the container 10 from the air intake opening 10*a* and generate cooling air C from the external air.

The cooling air C cools the electronic apparatuses 14. After that, the cooling air C is discharged from the air exhaust opening 10*b*.

Further, evaporative cooler 16 are provided between the fan unit 12 and the air intake opening 10*a*.

The evaporative cooler 16 are configured to bring external air into contact with an unillustrated element containing moisture to thereby generate air D lower in temperature than the external air, and supply the air D to the fan unit 12. Moreover, the humidity of the air D is made higher than that of the external air by the moisture of the element.

By using the air D which differs from the external air in temperature and humidity in this manner, it is possible to widen the ranges of adjustment of the temperature and humidity of the cooling air C.

Note that the evaporative cooler 16 may be omitted in some cases.

Figure 2:
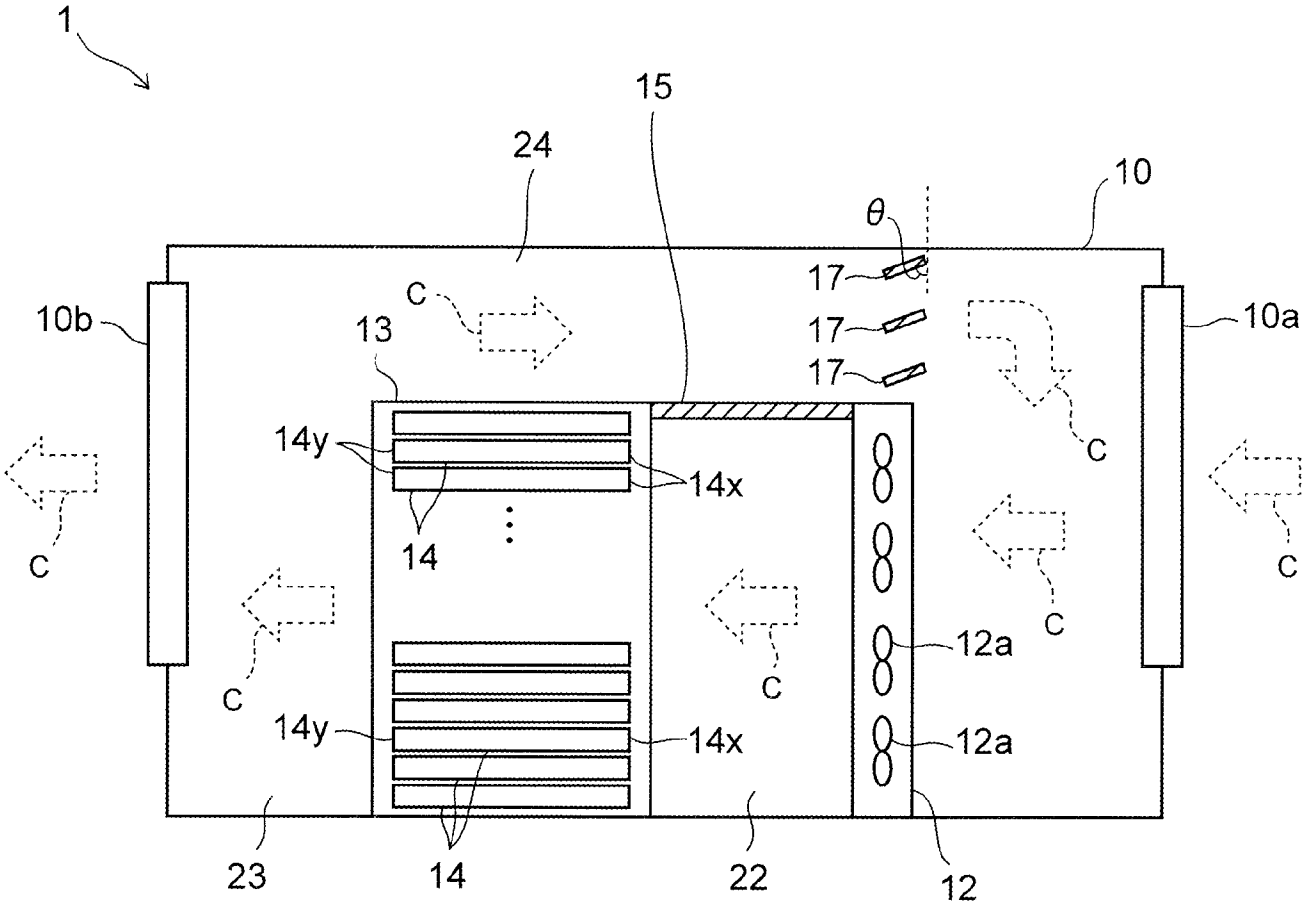
FIG. 2 is a schematic side view of the datacenter used for the consideration.

FIG. 2 is a schematic side view of the datacenter 1.

Note that the same elements in FIG. 2 as those described with reference to FIG. 1 are denoted by the same reference numerals as those in FIG. 1, and description thereof is omitted below.

As illustrated in FIG. 2, each electronic apparatus 14 has an intake surface 14*x* and an exhaust surface 14*y*. The cooling air C is taken into each electronic apparatus 14 from the intake surface 14*x* and then discharged from the exhaust surface 14*y*.

Moreover, the space between the fan unit 12 and the racks 13 serves as a cold isle 22, while the space between the racks 13 and the air exhaust opening 10*b* serves as a hot isle 23.

A partition plate 15 is provided above the cold isle 22. Moreover, this partition plate 15, the upper faces of the racks 13, and the ceiling surface of the container 10 define a flow path 24.

In this way, part of the warm cooling air C discharged from each electronic apparatus 14 flows through the flow path 24 and returns to the intake surface 14*y* of the electronic apparatus 14.

Provided at an end of the flow path 24 is damper 17 whose opening extent is adjustable. The definition of the opening extent is not particularly limited. Let $0°\text{-}\theta_{max}$ be the range in which an inclination angle θ of each damper 17 can be laid. Note that the angle θ is measured form the vertical direction. Then, by making correspondence between the range $0°\text{-}\theta_{max}$ and the range 0%-100% of the opening extent u, the opening extent u is associated with the angle θ in the following.

By adjusting the opening extent u of the damper 17, it is possible to adjust the flow rate of the warm cooling air C passing through the flow path 24, and thereby adjust the temperature and humidity of the cooling air C to be supplied to the intake surface 14*x*.

For example, by increasing the opening extent u of the damper 17, the warm cooling air C is supplied more to the intake surface 14*x* from the flow path 24. Thus, the temperature of the cooling air C at the intake surface 14*x* can be raised.

Moreover, since temperature and humidity have a negative correlation with each other, the humidity of the cooling air C at the intake surface 14*x* can be lowered as well.

On the other hand, in order to lower the temperature of the cooling air C at the intake surface 14*x* and to raise the humidity of the cooling air C at the intake surface 14*x*, the opening extent u of the damper 17 may be reduced instead.

Next, a method of adjusting the opening extent u of the damper 17 is discussed.

For each electronic apparatus 14, allowable ranges are sometimes set for a real temperature $T_{ca}$ and a real humidity $H_{ca}$ of the cooling air C to be taken from the intake surface 14*x*.

In the following, the upper and lower limits in the allowable temperature range will be described as $T_{max0}$ and $T_{min0}$, respectively. Also, the upper and lower limits in the allowable humidity range will be described as $H_{max0}$ and $H_{min0}$, respectively.

In order to keep the real temperature $T_{ca}$ and the real humidity $H_{ca}$ within the above-mentioned allowable ranges, it is required to adjust the opening extent u of the damper 17 in such a manner that the relations $T_{min0}<T_{ca}<T_{max0}$ and $H_{min0}<H_{ca}<H_{max0}$ hold.

In this example, the opening extent u of the damper 17 is adjusted by switching between two modes. One of the modes is a temperature control mode for controlling only the real temperature $T_{ca}$, and the other mode is a humidity control mode for controlling only the real humidity $H_{ca}$.

Here, the temperature control mode is a mode for controlling the opening extent u of the damper 17 such that the real temperature $T_{ca}$ satisfies the relation $T_{min0}<T_{ca}<T_{max0}$. In this mode, a PID controller controls the opening extent u of the damper 17 such that the real temperature $T_{ca}$ becomes equal to a target temperature, and the PID controller does not control the real humidity $H_{ca}$.

On the other hand, the humidity control mode is a mode for adjusting the opening extent u of the damper 17 such that the real humidity $H_{ca}$ satisfies the relation $H_{min0}<H_{ca}<H_{max0}$. In this mode, the PID controller controls the opening extent u of the damper 17 such that the real humidity $H_{ca}$ becomes equal to a target humidity, and the PID controller does not control the real temperature $T_{ca}$.

Which modes is to be selected is determined based on the real temperature $T_{ca}$ and the real humidity $H_{ca}$. For example, if the real temperature $T_{ca}$ is about to be out of the allowable range, the temperature control mode is selected in order to place priority on controlling the real temperature $T_{ca}$. On the other hand, if the real humidity $H_{ca}$ is about to be out of the allowable range, the humidity control mode is selected in order to place priority on controlling the real humidity $H_{ca}$.

By selecting between the temperature control mode and the humidity control mode in this manner, it is possible to the keep the real temperature $T_{ca}$ and the real humidity $H_{ca}$ within their allowable ranges.

However, according to an examination conducted by the inventor of this application, this method is found to have the following problem.

Figure 3A:
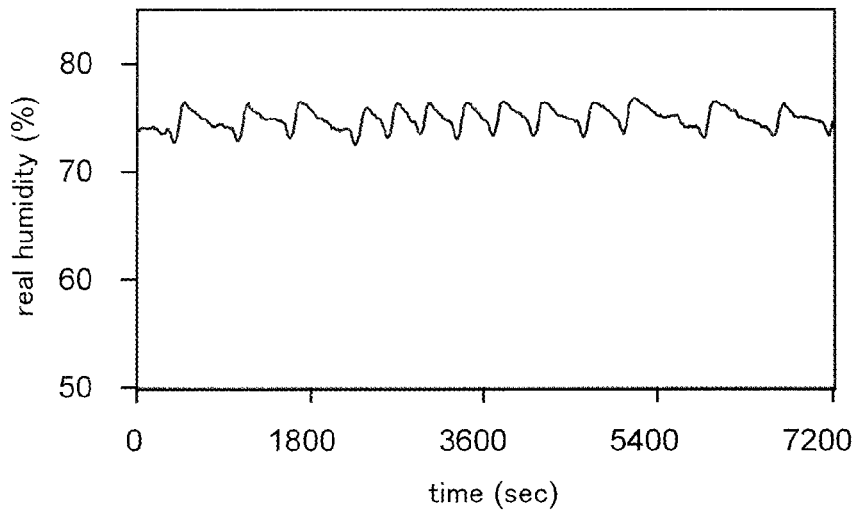
FIG. 3A is a graph obtained by studying the relationship between the time elapsed after start of control on damper, and real humidity in the datacenter in FIG. 1.

FIG. 3A is a graph obtained by studying the relationship between the time elapsed after starting the control on the damper 17, and the real humidity $H_{ca}$ of the cooling air C at the intake surface 14*x*.

Figure 3B:
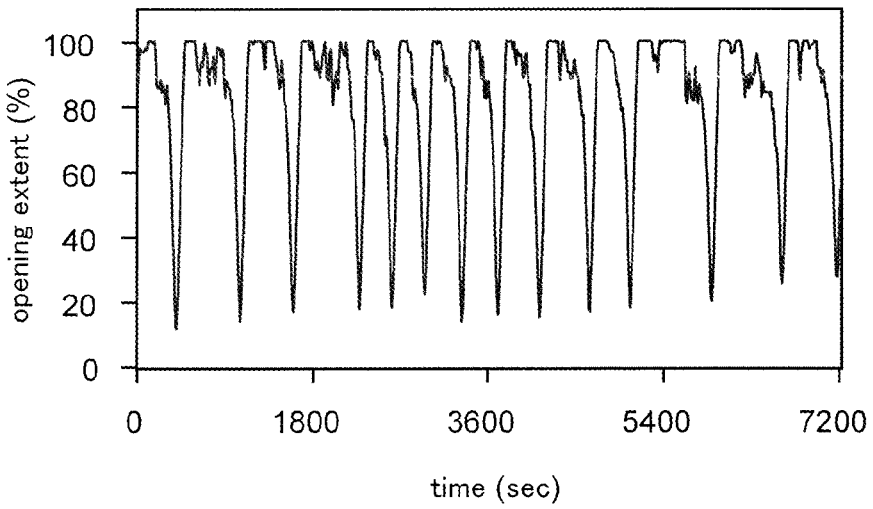
FIG. 3B is a graph obtained by studying the relationship between the time elapsed after start of the control on the damper, and the opening extent of the damper in the datacenter in FIG. 1.

Moreover, FIG. 3B is a graph obtained by studying the relationship between the time elapsed after starting the control on the damper 17, and the opening extent u of the damper 17.

As illustrated in FIG. 3B, in this control method, the opening extent u of the damper 17 fluctuates greatly. Due to this fluctuation, a hunting phenomenon is occurring in which the real humidity $H_{ca}$ greatly swings as illustrated in FIG. 3A.

The cause of this hunting phenomenon is considered that the opening extent u is adjusted by switching between the temperature control mode and the humidity control mode.

When the opening extent u of the damper 17 greatly changes due to the hunting phenomenon in this manner, the power for driving the damper 17 is wasted, thereby making it difficult to achieve energy saving of the datacenter 1.

(First Embodiment)

In this embodiment, the datacenter 1 illustrated in FIG. 1 and FIG. 2 is controlled as follows.

Figure 4:
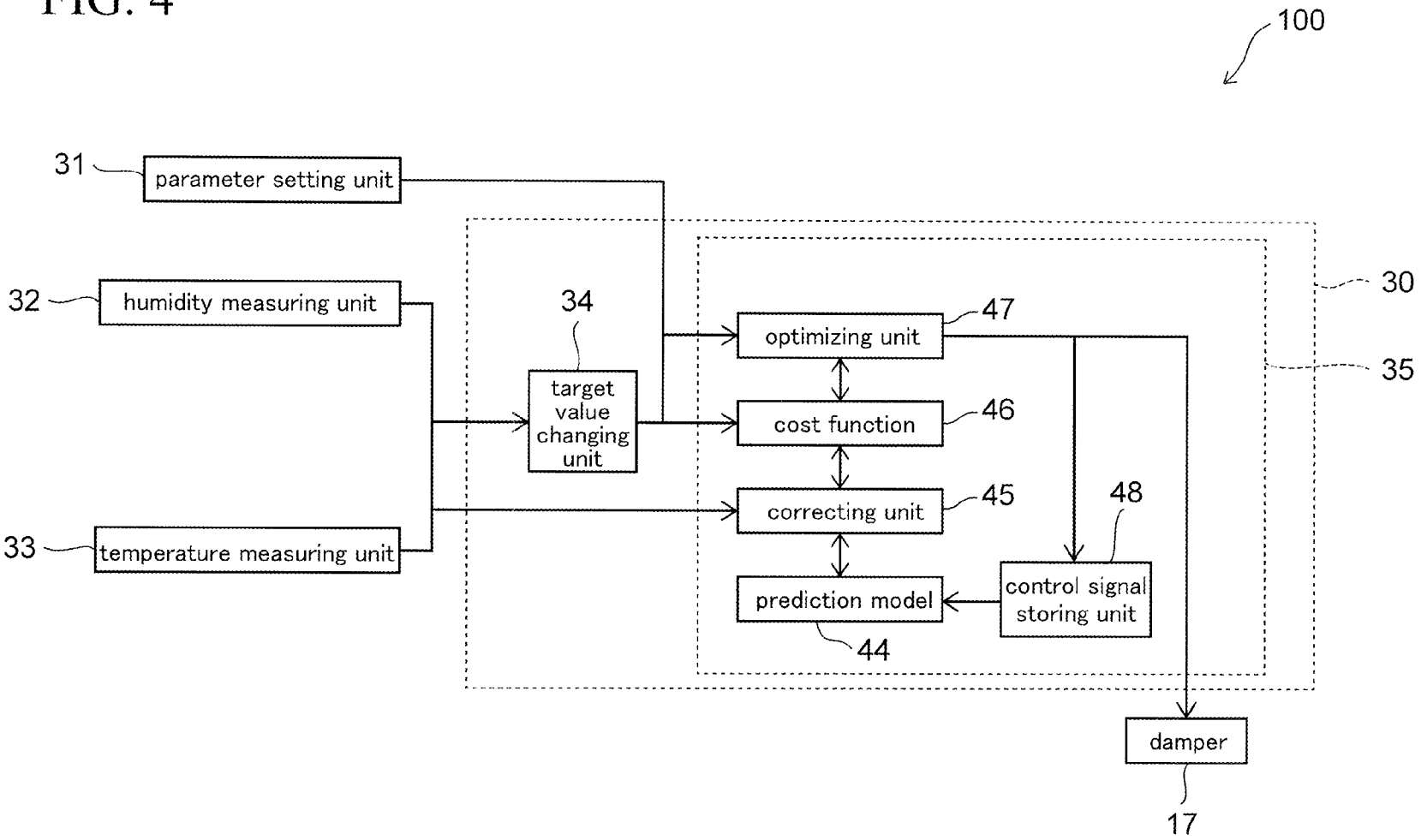
FIG. 4 is a functional block diagram of an air conditioning control system according to an embodiment.

FIG. 4 is a functional block diagram of an air conditioning control system according to this embodiment for controlling the air conditioning of the datacenter 1.

Note that the same elements in FIG. 4 as those described with reference to FIG. 1 and FIG. 2 are denoted by the same reference numerals as those in FIG. 1 and FIG. 2, and description thereof is omitted below.

As illustrated in FIG. 4, an air conditioning control system 100 includes a parameter setting unit 31, a humidity measuring unit 32, a temperature measuring unit 33, and a controlling unit 30.

The parameter setting unit 31 is configured to store various control parameters to be used to control the opening extent of the damper 17.

The humidity measuring unit 32 is configured to measure the real humidity $H_{ca}$ of the cooling air C at the intake surface 14*x* (see FIG. 2) of each electronic apparatus 14 and transfer the measurement result to the controlling unit 30.

Moreover, the temperature measuring unit 33 is configured to measure the real temperature $T_{ca}$ of the cooling air C at the intake surface 14*x* of each electronic apparatus 14 and transfer the measurement result to the controlling unit 30.

The number of humidity measuring units 32 is not particularly limited. The largest value of the humidity measured by a plurality of humidity measuring units 32 may be transferred as the real humidity $H_{ca}$ to the controlling unit 30. Likewise, the largest value of the temperature measured by a plurality of temperature measuring units 33 may be transferred as the real temperature $T_{ca}$ to the controlling unit 30.

On the other hand, the controlling unit 30 is, any one of a microcomputer, a field programmable gate array (FPGA), and a programmable logic controller (PLC) for example, and includes a target value changing unit 34 and a model predicting unit 35.

Note that a specific electronic apparatus 14 in a rack 13 may be used as the controlling unit 30 by loading a dedicated program onto that electronic apparatus 14.

The target value changing unit 34 is configured to set a target temperature $r_1$ and a target humidity $r_2$ of the cooling air C at the intake surface 14*x*. Moreover, the target value changing unit 34 changes the target temperature $r_1$ and the target humidity $r_2$ in accordance with the values of the real temperature $T_{ca}$ and the real humidity $H_{ca}$ respectively, and outputs these values $r_1$ and $r_2$ to the model predicting unit 35. How to change the target temperature $r_1$ and the target humidity $r_2$ will be described later.

Note that the target temperature $r_1$ and the target humidity $r_2$ will also be described below in a vector notation as in the equation (1) given below:

$$r = \begin{bmatrix} r_1 \\ r_2 \end{bmatrix}. \tag{1}$$

Moreover, the model predicting unit 35 includes a prediction model 44, a correcting unit 45, a cost function 46, an optimizing unit 47, and a control signal storing unit 48.

Among them, the prediction model 44 is configured to predict a predicted temperature $\tilde{y}_1$ of the real temperature $T_{ca}$ and a predicted humidity $\tilde{y}_2$ of the real humidity $H_{ca}$ in a future based on the opening extent u of the damper 17.

Note that the above predicted temperature and the predicted humidity will also be described below in a vector notation as in the equation (2) given below:

$$\tilde{y} = \begin{bmatrix} \tilde{y}_1 \\ \tilde{y}_2 \end{bmatrix} \tag{2}$$

Moreover, the correcting unit 45 is configured to correct this predicted value $\tilde{y}$ so as to bring it close to the real temperature and humidity of the cooling air C at the intake surface 14*x*.

Further, the cost function 46 is a function which weights the difference between the predicted value $\tilde{y}$ and the target value r, and its form will be described later.

Furthermore, the optimizing unit 47 is configured to calculate, in a predetermined period of time from the present to a future, a manipulation amount $\Delta u$ that minimizes the value J of the cost function 46 and satisfies later-described constraint conditions. The manipulation amount $\Delta u$ thus calculated is output to the control signal storing unit 48 and the damper 17 by the optimizing unit 47.

Moreover, the control signal storing unit 48 is configured to store the past manipulation amount $\Delta u$ of the opening extent of the damper 17 and output the manipulation amount $\Delta u$ to the prediction model 44.

Next, an air conditioning control method according to this embodiment will be described.

Figure 5:
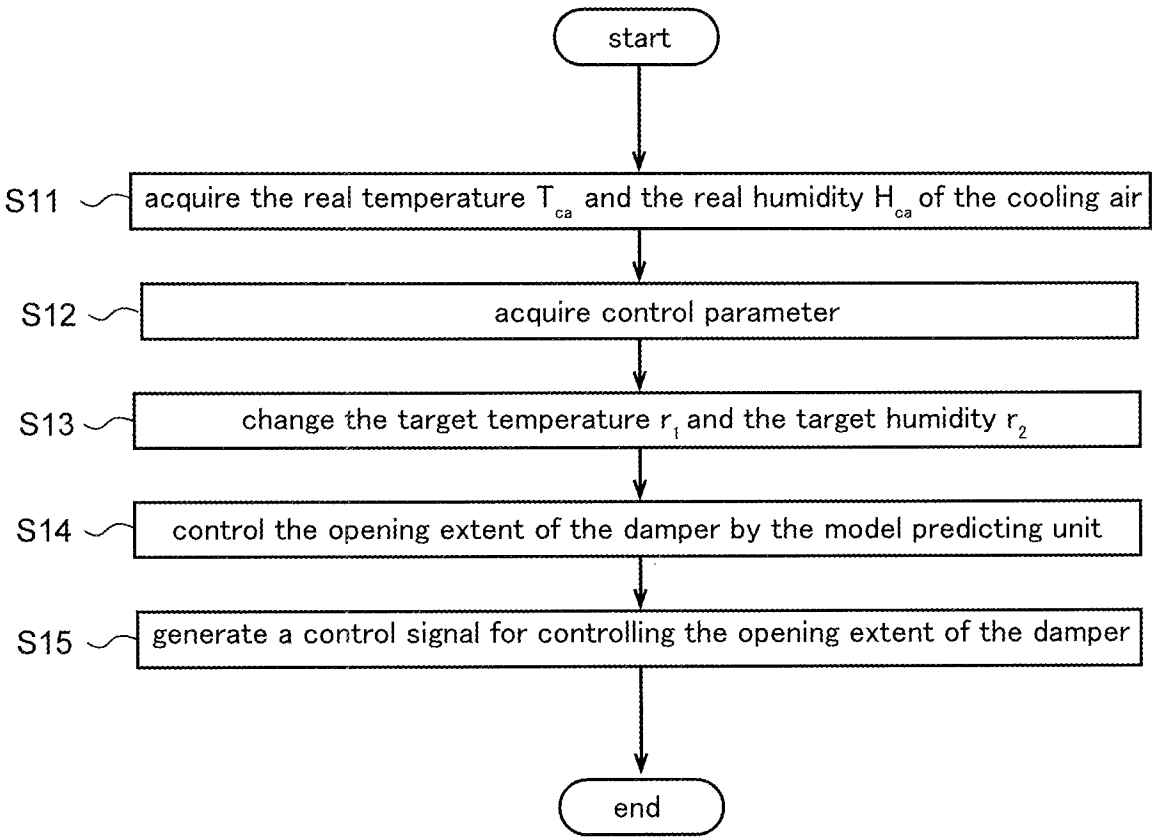
FIG. 5 is a flowchart illustrating an air conditioning control method according to this embodiment.

FIG. 5 is a flowchart illustrating the air conditioning control method according to this embodiment.

This flowchart is carried out by the controlling unit 30 in a predetermined control cycle $\Delta t$. The control cycle $\Delta t$ is an integer representing the cycle in which this flowchart is carried out, and is 1 second, for example.

First, in step S11, the controlling unit 30 acquires the real temperature $T_{ca}$ and the real humidity $H_{ca}$ of the cooling air C at the intake surface 14*x*. Among them, the real temperature $T_{ca}$ is acquired from the temperature measuring unit 33 by the controlling unit 30. Then, the real humidity $H_{ca}$ is acquired from the humidity measuring unit 32 by the controlling unit 30.

Next, the method proceeds to step S12, in which the controlling unit 30 acquires various control parameters from the parameter setting unit 31.

The control parameters include the allowable ranges of each of the real temperature $T_{ca}$ and the real humidity $H_{ca}$, for example. The allowable ranges are not particularly limited. In the following, the lower limit temperature $T_{min0}$ of the real temperature $T_{ca}$ is 10° C., and the upper limit temperature $T_{max0}$ of the real temperature $T_{ca}$ is 35° C. Moreover, the lower limit humidity $H_{min0}$ of the real humidity $H_{ca}$ is 10%, and the upper limit humidity $H_{max0}$ of the real humidity $H_{ca}$ is 85%.

Next, the method proceeds to step S13, in which the target value changing unit 34 changes the target temperature $r_1$ and the target humidity $r_2$ in accordance with the values of the real temperature $T_{ca}$ and the real humidity $H_{ca}$, respectively. How to makes the changes will be described later in detail.

Then, the method proceeds to step S14.

In step S14, the model predicting unit 35 predicts the future predicted temperature $\tilde{y}_1$ of the real temperature $T_{ca}$ and the future predicted humidity $\tilde{y}_2$ of the real humidity $H_{ca}$, and controls the opening extent of the damper 17 such that the real temperature $T_{ca}$ becomes close to the target temperature $r_1$ and the real humidity $H_{ca}$ becomes close to the target humidity $r_2$. This control is performed by using a prediction model as follows.

The general equations of this prediction model are described bt the equations (3) and (4) given below:

$$\tilde{y}_1(k+1)=f_1(u(k)) \tag{3}$$

$$\tilde{y}_2(k+1)=f_2(u(k)) \tag{4}$$

The equation (3) is a temperature prediction model, and the equation (4) is a humidity prediction model. A time point k is included in both prediction models (3) and (4). The time point k is an integer indicating the number of times that the controlling unit 30 carries out the flowchart in FIG. 5. Thus, the equations (3) and (4) are interpreted as the equations to find a temperature $y_1$ and a humidity $y_2$ at a future time point k+1 based on an opening extent u(k) of the damper at the time point k.

Note that the equation (3) and the equation (4) are described together in a vector notation as in the equation (5) given below:

$$\begin{bmatrix} \tilde{y}_1(k+1) \\ \tilde{y}_2(k+1) \end{bmatrix} = \begin{bmatrix} f_1(u(k)) \\ f_2(u(k)) \end{bmatrix}. \tag{5}$$

Further, by collecting the functions $f_1$ and $f_2$ into a function f, the equation (5) can be described as the equation (6) given below:

$$\tilde{y}(k+1)=f(u(k)) \tag{6}$$

In this embodiment, the general equation (6) is specialized as in the equations (7) and (8) given below:

$$x(k+1)=Ax(k)+B_u u(k) \tag{7}$$

$$\tilde{y}(k)=C\cdot x(k) \tag{8}$$

Note that x(k) in the equations (7) and (8) is a state variable at the time point k and is a n-dimensional (n is a natural number) vector. Moreover, A is an n×n matrix, $B_u$ is an n-dimensional vector, and C is an n-dimensional vector.

Note also that the each components of A, $B_u$, and C can be found by system identification based on test data such that a predicted value $\tilde{y}$ of the future real temperature and real humidity of the cooling air C can be best approximated. Examples of the system identification include, for example, a prediction error method or a subspace identification method.

Moreover, when it is possible to derive a differential equation of a physics model which expresses the dynamic characteristics of the real temperature and real humidity of the cooling air C, the components of A, $B_u$, and C can be found by linearizing the differential equation through the Taylor expansion.

Further, it is known that n is determined by an order $n_{d1}$ of the temperature prediction model, dead times $d_{t1}$, $d_{t2}$, and an order $n_{d2}$ of the humidity prediction model, and is expressed as $n=n_{d1}+d_{t1}+n_{d2}+d_{t2}$. The reason for this will be explained in a later-described reference example.

Note that the dead time $d_{t1}$ is a dead time of the temperature of the cooling air C at the intake surface 14*x* with respect to the opening extent of the damper 17. The dead time $d_{t2}$ is a dead time of the humidity of the cooling air C at the intake surface 14*x* with respect to the opening extent of the damper 17. In this embodiment, the dead times $d_{t1}$ and $d_{t2}$ are rounded off to integer values, and the dead times $d_{t1}$ and $d_{t2}$ are set to 1 second.

Meanwhile, although a state-space model is used in the above case, the model may be expressed as a multiple regression model or data such as a map function.

Next, the correcting unit 45 corrects the predicted value $\tilde{y}(k+1)$ of the temperature and humidity at the time point k+1 based on the equation (9) given below to calculate a corrected predicted value y(k+1|k):

$$y(k+1|k)=\tilde{y}(k+1|k)+(y_{real}(k)-y(k|k-1)) \tag{9}$$

Here, $$y = \begin{bmatrix} y_1 \\ y_2 \end{bmatrix}, \tag{10}$$

where $y_1$ represents the temperature after the correction, and $y_2$ represents the humidity after the correction.

Further, $$y_{real}(k) = \begin{bmatrix} T_{ca}(k) \\ H_{ca}(k) \end{bmatrix}, \tag{11}$$

where $T_{ca}(k)$ and $H_{ca}(k)$ are the temperature and the humidity at the time point k acquired in step S11, respectively.

In the equation (9) and the subsequent equations, when a variable $\alpha$ at a time point p is to be calculated from information at a time point q, the variable $\alpha$ will be described as $\alpha(p|q)$.

The first term of the right-hand side of the equation (9), $\tilde{y}(k+1|k)$, is the uncorrected predicted value of the temperature and humidity of the cooling air C at the time point k+1.

Moreover, the second term of the right-hand side of the equation (9) is a correction term. $y(k|k-1)$ appearing in the correction term is the predicted value of the temperature and humidity of the cooling air C at the intake surface 14*x* at the time point k.

At the time point k, the real value is deviated from the predicted value by $y_{real}(k)-y(k|k-1)$. Therefore, by adding $y_{real}(k)-y(k|k-1)$ to the right-hand side of the equation (9), it is possible to prevent the predicted value at the time point k+1 from deviating from the real value.

Note that the above correction may be omitted in some cases.

Here, a future period p is introduced. The future period p is an integer indicating a period of time from the present to a future at which the temperature and humidity of the cooling air C is to be predicted. In the following, the future period p is 100, for example.

Then, the change amount $\Delta u$ of the opening extent of the damper 17 is defined as in the equation (12) given below:

$$u(k+i|k)=u(k+i-1|k)+\Delta u(k+i|k)$$

$$(i=0,1,\ldots,p-1) \tag{12}$$

In the equation (12), i is an index which equally divides the future period p into p parts.

As can be understood from the equation (12), a change amount $\Delta u(k+i|k)$ is defined by an opening extent $u(k+i|k)$ of the damper 17 at a time point k+i, and an opening extent $u(k+i-1|k)$ of the damper 17 at a time point k+i−1, which is the antecedent time point of k+i by one step.

Moreover, as each opening extent u(k) in the equation (12), those stored in the control signal storing unit 48 can be used.

Note that since the opening extent of the damper 17 is manipulated by the controlling unit 30, the change amount $\Delta u$ will also be called the manipulation amount $\Delta u$ in the following.

By using the index i in the equation (12), the equations (7) to (9) mentioned above can be expressed as the equations (13) to (15) given below, respectively:

$$x(k+i+1|k)=Ax(k+i|k)+B_u u(k+i|k) \tag{13}$$

$$\tilde{y}(k+i+1|k)=C\cdot x(k+i+1|k) \tag{14}$$

$$y(k+i+1|k)=\tilde{y}(k+i+1|k)+(y_{real}(k)-y(k|k-1)) \tag{15}$$

Further, the allowable ranges of the parameters are defined as in the equations (16) to (19) given below:

$$T_{min}\le y_1(k+i+1|k)\le T_{max} \tag{16}$$

$$H_{min}\le y_2(k+i+1|k)\le H_{max} \tag{17}$$

$$\Delta u_{min}\le \Delta u(k+i|k)\le \Delta u_{max} \tag{18}$$

$$u_{min}\le u(k+i|k)\le u_{max} \tag{19}$$

The equation (16) defines the allowable range of the temperature $y_1$ of the cooling air C at the intake surface 14*x*.

Similarly, the equation (17) defines the allowable range of the humidity $y_2$ of the cooling air C at the intake surface 14*x*.

The equation (18) defines the allowable range of the manipulation amount $\Delta u$ of the damper 17. A minimum value $\Delta u_{min}$ and a maximum value $\Delta u_{max}$ of this allowable range are limit values that the opening extent of the damper 17 can be changed in one manipulation.

Moreover, the equation (19) defines the allowable range of the opening extent u of the damper 17. $U_{min}$ and $U_{max}$ represent the lower limit value and upper limit value of that allowable range, respectively.

The parameters $y_1$, $y_2$, $\Delta u$, and u are subjected to the constraint conditions of the equations (16) to (19), respectively.

Moreover, in this embodiment, besides the above constraint conditions, the equation (20) given below is provided as another constraint condition on the manipulation amount $\Delta u$:

$$\Delta u(k+h|k)=0$$

$$(h=m,\ldots,p-1) \tag{20}$$

The equation (20) indicates that the manipulation amount $\Delta u$ becomes 0 at and after a time point k+m. This is based on an idea that the manipulation amount $\Delta u$ should gradually approach 0 toward the end of the future period, instead of shifting the manipulation amount $\Delta u$ suddenly to 0 at the end of the future period.

Meanwhile, the value of m is not particularly limited. In this example, m is set to 1.

Next, the optimizing unit 47 calls the cost function 46 which is described as in the equation (21) given below:

$$J(k) = \sum_{i=0}^{p-1} [y(k+i+1|k)-r(k+i+1)]^T Q[y(k+i+1|k)-r(k+i+1)] + \Delta u(k+i|k)R_{\Delta u}\Delta u(k+i|k) + [u(k+i|k) - u_{target}(k+i)]R_u[u(k+i|k)-u_{target}(k+1)]. \tag{21}$$

In the equation (21), Q is a 2×2 matrix representing a weight, and $R\Delta_u$ and $R_u$ are scalars representing weights.

In the first term of the right-hand side of the equation (21), the difference $(y_1-r_1)$ between the predicted temperature $y_1$ and the target temperature $r_1$, and the difference $(y_2-r_2)$ between the predicted humidity $y_2$ and the target humidity $r_2$ are weighted. This first term represents an operation to bring the temperature $y_1$ and the humidity $y_2$, which are control targets, close to their respective target values $r_1$ and $r_2$, and the matrix Q is a weight for the operation, i.e. a target value following parameter.

The second term of the right-hand side of the equation (21) represents an operation to bring the change amount Δu of the manipulation amount u close to 0, and $R\Delta_u$ is a weight for this operation, i.e. a manipulation amount reducing parameter. The smaller the $R\Delta_u$, the larger the change amount Δu, and the larger the $R\Delta_u$, the smaller the change amount Δu.

The third term of the right-hand side of the equation (21) represents an operation to bring the opening extent u of the damper 17 close to a target opening extent $U_{target}$. In this embodiment, $u_{target}$ is set to 0. $R_u$ is a weight for the operation to bring the opening extent close to the target opening extent $u_{target}$, i.e. a manipulation amount shift width parameter.

These control parameters Q, $R\Delta_u$, and $R_u$ are stored in the parameter setting unit 31 mentioned above, and are acquired by the model predicting unit 35 in step S12 in advance.

Then, the optimizing unit 47 calculates an input sequence of the manipulation amounts Δu which minimize the value J of the cost function 46, based on the equation (22) given below:

$$\{\Delta u_{opt}(k\mid k), \ldots, \Delta u_{opt}(m-1+k\mid k)\}\arg\min_{\Delta u(k|k),\ldots,\Delta u(m-1+k|k)} J(k). \quad (22)$$

Then, the optimizing unit 47 extracts the first element $\Delta u_{opt}(k|k)$ in the optimum input sequence $\{\Delta u_{opt}(k|k), \ldots, \Delta u_{opt}(m-1+k|k)\}$ calculated from the equation (22).

Further, the optimizing unit 47 calculates the opening extent u(k) of the damper 17 at the time point k from the equation (23) given below:

$$u(k)=u(k-1)+\Delta u_{opt}(k|k) \quad (23).$$

The optimizing solver which minimizes the cost function 46 may use a metaheuristic numerical solution which searches for an approximate solution such as an genetic algorithm (GA) or particle swarm optimization (PSO). Note that sequential quadratic programming (SQP) is used in this example to solve a quadratic programming problem.

By the above operation, step S14 ends.

Thereafter, the method proceeds to step S15, in which the controlling unit 30 generates a control signal for controlling the opening extent of the damper 17 and changes the opening extent of the damper 17 to u(k) appearing in the equation (23).

By the above operation, the basic steps of the air conditioning control method according to this embodiment ends.

Figure 6A:
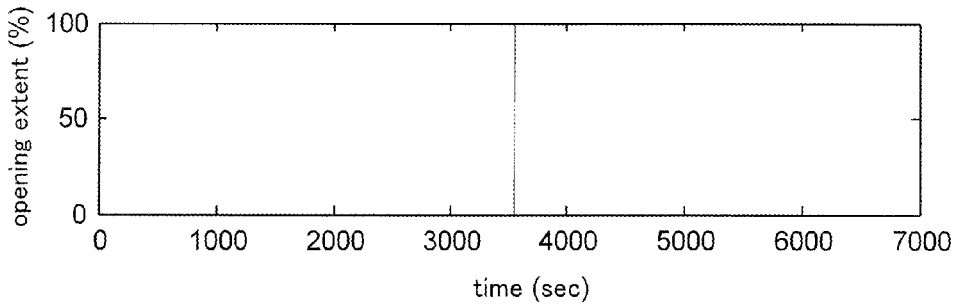
FIG. 6A is a graph illustrating the relationship between the time elapsed after start of control, and the opening extent of damper according to this embodiment.
Figure 6B:
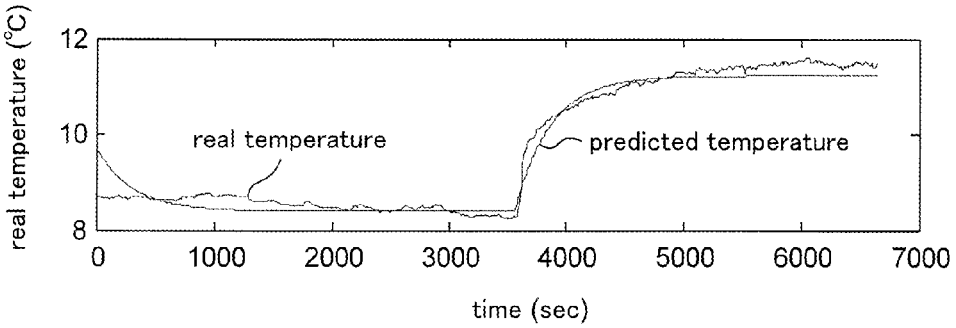
FIG. 6B is a graph illustrating the relationship between the elapsed time and the real temperature of cooling air at an intake surface according to this embodiment.
Figure 6C:
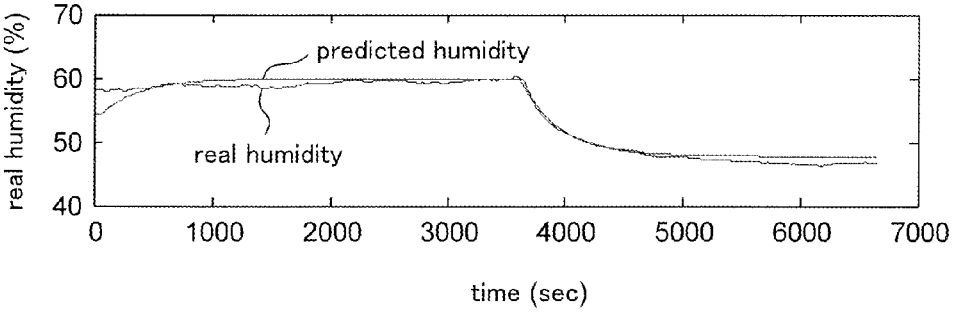
FIG. 6C is a graph illustrating the relationship between the elapsed time and the real humidity of the cooling air at the intake surface according to this embodiment.

FIGS. 6A to 6C are graphs illustrating one exemplary result that are obtained by controlling the datacenter 1 using the above-described air conditioning control method.

FIG. 6A is a graph illustrating the relationship between the time elapsed after start of the control, and the opening extent of the damper 17.

Further, FIG. 6B is a graph illustrating the relationship between the above elapsed time and the real temperature $T_{ca}$ of the cooling air at the intake surface 14*x*.

Furthermore, FIG. 6C is a graph illustrating the relationship between the above elapsed time and the real humidity $H_{ca}$ of the cooling air at the intake surface 14*x*.

As illustrated in FIGS. 6B and 6C, the real temperature $T_{ca}$ and the real humidity $H_{ca}$ substantially match their predicted values.

Next, a method of changing the target temperature $r_1$ and the target humidity $r_2$ in the target value changing unit 34 will be described.

In this embodiment, the target temperature $r_1$ and the target humidity $r_2$ are not fixed at certain values but are dynamically changed in the following way in accordance with the values of the real temperature $T_{ca}$ and the real humidity $H_{ca}$, respectively.

Figure 7:
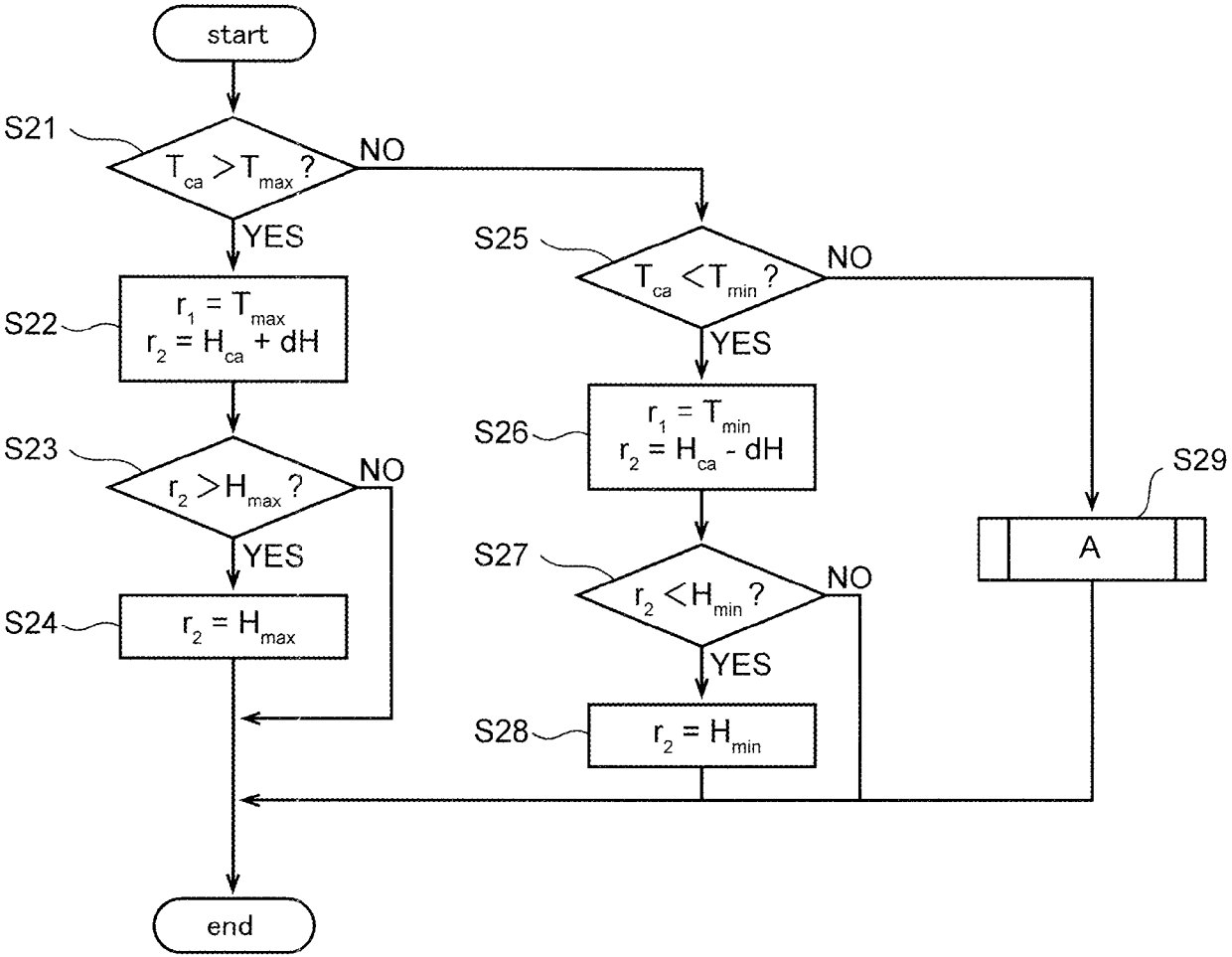
FIG. 7 is a flowchart illustrating a method of changing a target temperature and a target humidity with a target value changing unit according to this embodiment (part 1)
Figure 8:
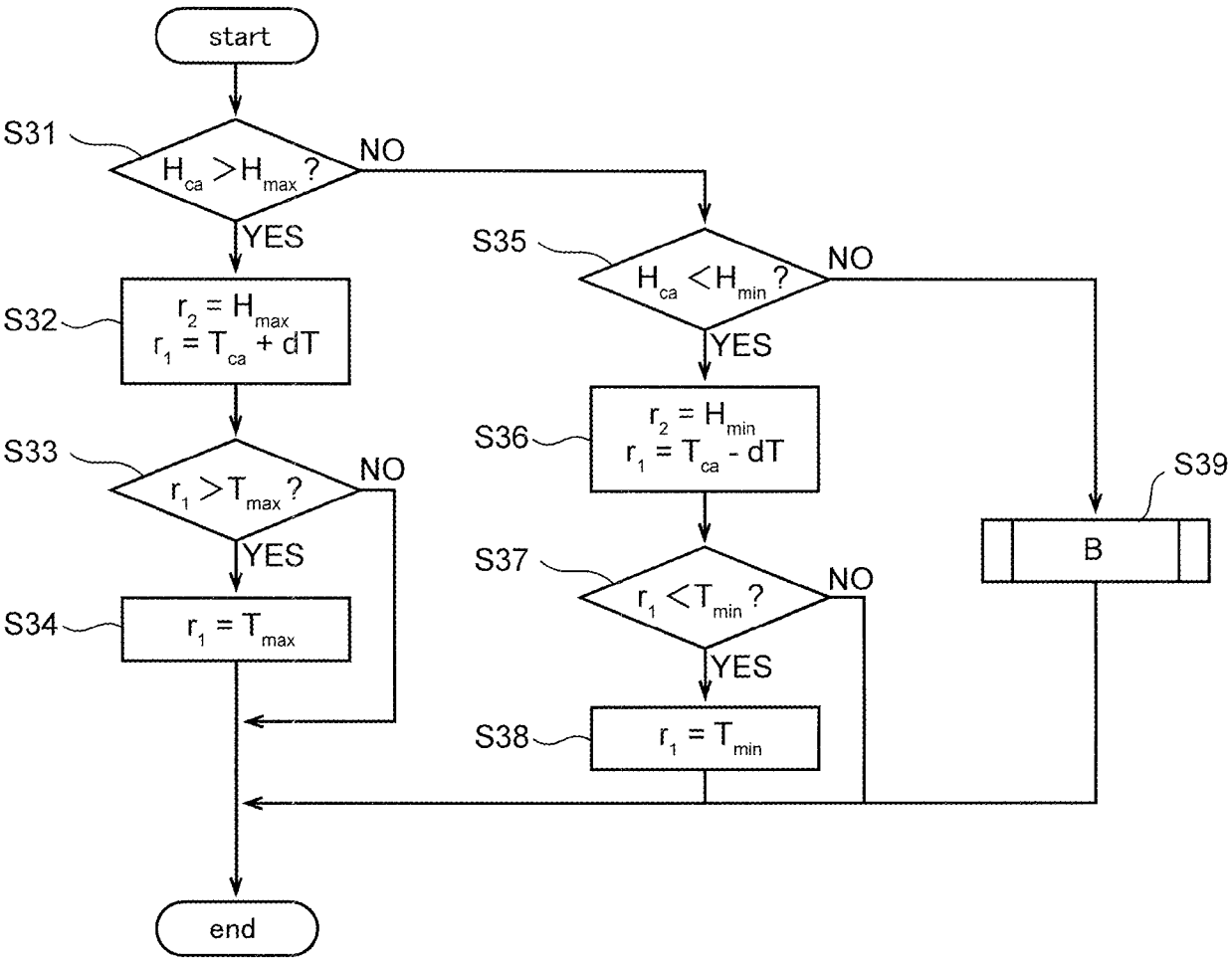
FIG. 8 is a flowchart illustrating the method of changing the target temperature and the target humidity with the target value changing unit according to this embodiment (part 2)
Figure 9:
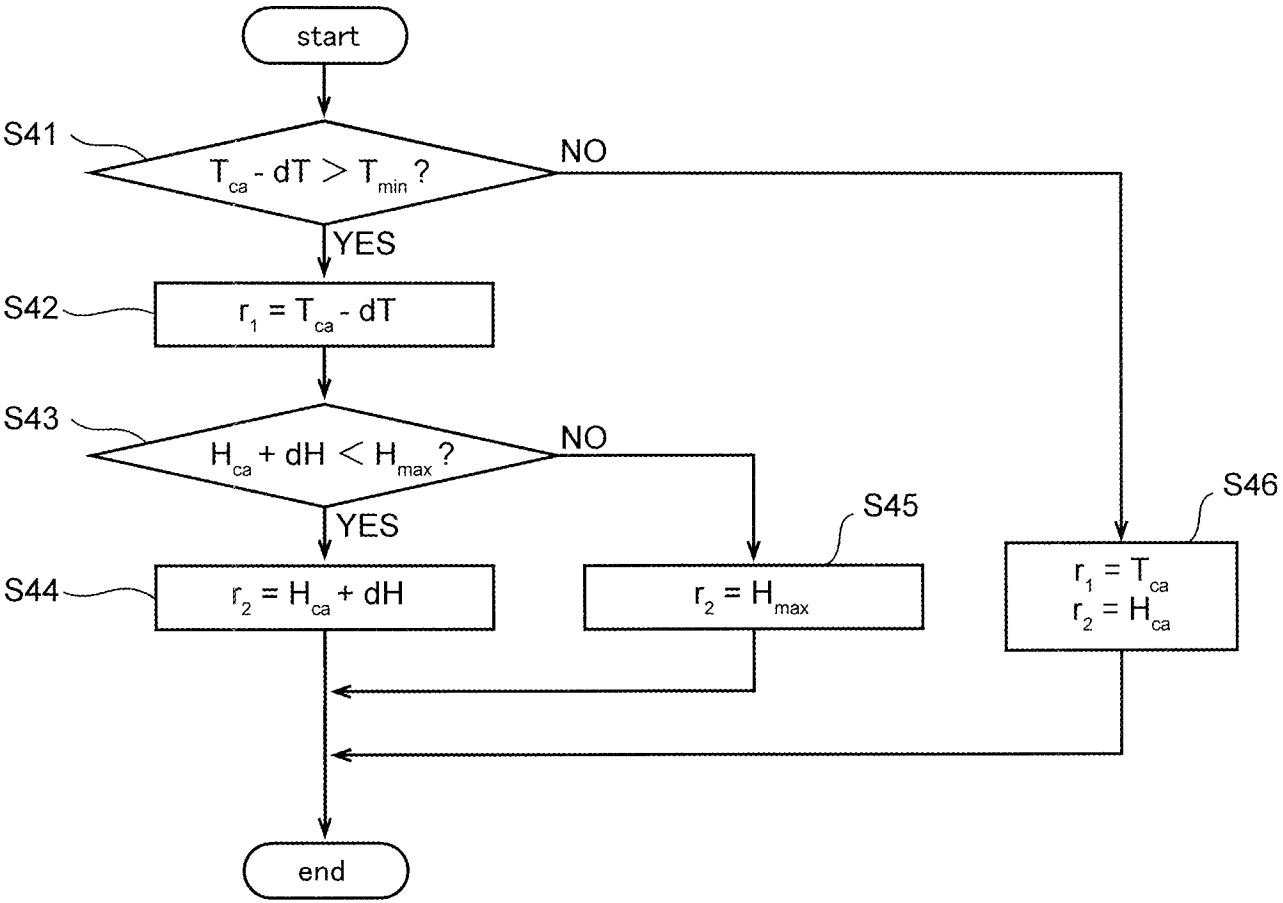
FIG. 9 is a flowchart illustrating the method of changing the target temperature and the target humidity with the target value changing unit according to this embodiment (part 3)

FIGS. 7 to 9 are flowcharts illustrating the method of changing the target temperature $r_1$ and the target humidity $r_2$ in the target value changing unit 34.

Here, the definitions of the symbols used in this example are listed below again.

$r_1$: target temperature $r_2$: target humidity $T_{max0}$: upper limit temperature $T_{min0}$: lower limit temperature $H_{max0}$: upper limit humidity $H_{min0}$: lower limit humidity If the real temperature is too close to the limit value $T_{max0}$ or $T_{min0}$, the real temperature may exceed or fall below the limit value. To deal with this problem, margins are provided to each of the limit values $T_{max0}$ and $T_{min0}$ in this example, and the limit values $T_{max0}$ and $T_{min0}$ thus provided with the margins are employed as new limit values $T_{max}$ and $T_{min}$ as follows:

$$T_{max}=T_{max0}-m_T$$

$$T_{min}=T_{min0}+m_T,$$

where $m_T$ is a positive value determined in view of the margin, and $m_T$=1 in this example.

For the same reason, the following new limit values $H_{max}$ and $H_{min}$ are employed for the humidity:

$$H_{max}=H_{max0}-m_H$$

$$H_{min}=H_{min0}+m_H,$$

where $m_H$ is a positive value determined in view of the margin, and $m_H$=1 in this example.

Moreover, the smallest unit of change for the target temperature $r_1$ by the target value changing unit 34 is defined as dT, and the target temperature $r_1$ is raised or lowered by the unit dT.

Likewise, the smallest unit of change for the target humidity $r_2$ by the target value changing unit 34 is defined as dH, and the target humidity $r_2$ is raised or lowered by the unit dH.

In this example, dT=dH=5.

First, in step S21 in FIG. 7, it is determined whether or not the real temperature $T_{ca}$ is higher than the upper limit temperature $T_{max}$.

When it is determined that the real temperature $T_{ca}$ is higher than the upper limit temperature $T_{max}$ (YES), the method proceeds to step S22, in which the real temperature $T_{ca}$ is lowered.

To lower the real temperature $T_{ca}$, it is only required to change the target temperature $r_1$ to a lower temperature than the real temperature $T_{ca}$. In this example, the target temperature $r_1$ is changed such that $r_1=T_{max}$.

Meanwhile, as opposed to the lowering the real temperature $T_{ca}$, the target humidity $r_2$ is changed so as to raise the real humidity $H_{ca}$. In this example, the real humidity $H_{ca}$ is raised by changing the target humidity $r_2$ such that $r_2=H_{ca}$+dH.

The real temperature $T_{ca}$ and the real humidity $H_{ca}$ have a negative correlation with each other. Therefore, when the real temperature $T_{ca}$ is desired to be lowered, the target humidity $r_2$ is changed in the opposite way, i.e. raised. As a result, as the real temperature $T_{ca}$ is lowered, the real humidity $H_{ca}$ is automatically brought close to the target humidity $r_2$. In this way, the real temperature $T_{ca}$ and the real humidity $H_{ca}$ can be easily brought close to their respective target temperature $r_1$ and target humidity $r_2$ through the adjustment of the opening extent of the damper 17.

Then, in order to check whether the target humidity $r_2$ changed in step S22 is within the allowable range, the method proceeds to step S23, in which it is determined whether or not the target humidity $r_2$ is higher than the upper limit humidity $H_{max}$.

Here, when it is determined that the target humidity $r_2$ is higher than the upper limit humidity $H_{max}$ (YES), the method proceeds to step S24.

In step S24, the target humidity $r_2$ is changed such that $r_2=H_{max}$, to thereby bring the target humidity $r_2$ within the allowable range.

On the other hand, when it is determined in step S23 that the target humidity $r_2$ is not higher than the upper limit humidity $H_{max}$ (NO), the method is ended.

Next, the case where it is determined in step S21 that the real temperature $T_{ca}$ is not higher than the upper limit temperature $T_{max}$ (NO) will be described.

In this case, the method proceeds to step S25, in which it is determined whether or not the real temperature $T_{ca}$ is lower than the lower limit temperature $T_{min}$.

Here, when it is determined that the real temperature $T_{ca}$ is lower than the lower limit temperature $T_{min}$ (YES), the method proceeds to step S26, in which the real temperature $T_{ca}$ is raised.

To raise the real temperature $T_{ca}$, it is only required to change the target temperature $r_1$ to a higher temperature than the real temperature $T_{ca}$. In this example, the target temperature $r_1$ is changed such that $r_1=T_{min}$.

Moreover, as opposed to raising the real temperature $T_{ca}$ in this manner, the target humidity $r_2$ is changed so as to lower the real humidity $H_{ca}$. In this example, the real humidity $H_{ca}$ is lowered by changing the target humidity $r_2$ such that $r_2=H_{ca}-dH$.

By raising and lowering the real temperature $T_{ca}$ and the real humidity $H_{ca}$ in the opposite directions in this manner, the real temperature $T_{ca}$ and the real humidity $H_{ca}$ can be easily brought close to their respective target temperature $r_1$ and target humidity $r_2$ through the adjustment of the opening extent of the damper 17 for the same reason as that for step S22 mentioned above.

Next, to check whether the target humidity $r_2$ changed in step S26 is within the allowable range, the method proceeds to step S27, in which it is determined whether or not the target humidity $r_2$ is lower than the lower limit humidity $H_{min}$.

Here, when it is determined that the target humidity $r_2$ is lower than the lower limit humidity $H_{min}$ (YES), the method proceeds to step S28.

In step S28, the target humidity $r_2$ is changed such that $r_2=H_{min}$, to thereby bring the target humidity $r_2$ within the allowable range.

On the other hand, when it is determined in step S27 that the target humidity $r_2$ is not lower than the lower limit humidity $H_{min}$ (NO), the method is ended.

Next, the case where it is determined in step S25 that the real temperature $T_{ca}$ is not lower than the lower limit temperature $T_{min}$ (NO) will be described.

In this case, the method proceeds to a subroutine A of step S29.

FIG. 8 is a flowchart illustrating the content of processing in the subroutine A.

First, in step S31, it is determined whether or not the real humidity $H_{ca}$ is higher than the upper limit humidity $H_{max}$.

Here, when it is determined that the real humidity $H_{ca}$ is higher than the upper limit humidity $H_{max}$ (YES), the method proceeds to step S32, in which the real humidity $H_{ca}$ is lowered.

To lower the real humidity $H_{ca}$, it is only required to change the target humidity $r_2$ to a lower humidity than the real humidity $H_{ca}$. In this example, the target humidity $r_2$ is changed such that $r_2=H_{max}$.

Moreover, as opposed to lowering the real humidity $H_{ca}$ in this manner, the target temperature $r_1$ is changed so as to raise the real temperature $T_{ca}$. In this example, the real temperature $T_{ma}$ is raised by changing the target temperature $r_1$ such that $r_1=T_{ca}+dH$.

As mentioned above, the real temperature $T_{ca}$ and the real humidity $H_{ca}$ have a negative correlation with each other. For this reason, when the real humidity $H_{ca}$ is desired to be lowered, the target temperature $r_1$ is changed in the opposite way, i.e. raised. Thus, as the real humidity $H_{ca}$ is lowered, the real temperature $T_{ca}$ is automatically brought close to the target temperature $r_1$. In this way, the real temperature $T_{ca}$ and the real humidity $H_{ca}$ can be easily brought close to their respective target temperature $r_1$ and target humidity $r_2$ through the adjustment of the opening extent of the damper 17.

Next, to check whether the target temperature $r_1$ changed in step S32 is within the allowable range, the method proceeds to step S33, in which it is determined whether or not the target temperature $r_1$ is higher than the upper limit temperature $T_{max}$ Here, when it is determined that the target temperature $r_1$ is higher than the upper limit temperature $T_{max}$ (YES), the method proceeds to step S34.

In step S34, the target temperature $r_1$ is changed such that $r_1=T_{max}$, to thereby bring the target temperature $r_1$ within the allowable range.

On the other hand, when it is determined in step S33 that the target temperature $r_1$ is not higher than the upper limit temperature $T_{max}$ (NO), the method is ended.

Next, the case where it is determined in step S31 described above that the real humidity $H_{ca}$ is not higher than the upper limit humidity $H_{max}$ (NO) will be described.

In this case, the method proceeds to step S35, in which it is determined whether or not the real humidity $H_{ca}$ is lower than the lower limit humidity $H_{min}$.

Here, when it is determined that the real humidity $H_{ca}$ is lower than the lower limit humidity $H_{min}$ (YES), the method proceeds to step S36, in which the real humidity $H_{ca}$ is raised.

To raise the real humidity $H_{ca}$, it is only required to change the target humidity $r_2$ to a higher humidity than the real humidity $H_{ca}$. In this example, the target humidity $r_2$ is changed such that $r_2=H_{min}$.

Moreover, as opposed to raising the real humidity $H_{ca}$ in this manner, the target temperature $r_1$ is changed so as to lower the real temperature $T_{ca}$. In this example, the real temperature $T_{ca}$ is lowered by changing the target temperature $r_1$ such that $r_1=T_{ca}-dT$.

By raising and lowering the real temperature $T_{ca}$ and the real humidity $H_{ca}$ in the opposite directions in this manner, the real temperature $T_{ca}$ and the real humidity $H_{ca}$ can be easily brought close to their respective target temperature $r_1$ and target humidity $r_2$ through the adjustment of the opening extent of the damper 17 as in the case of step S32 mentioned above.

Then, to check whether the target temperature $r_1$ changed in step S36 is within the allowable range, the method proceeds to step S37, in which it is determined whether or not the target temperature $r_1$ is lower than the lower limit temperature $T_{min}$.

Here, when it is determined that the target temperature $r_1$ is lower than the lower limit temperature $T_{min}$ (YES), the method proceeds to step S38.

In step S38, the target temperature $r_1$ is changed such that $r_1=T_{min}$, to thereby bring the target temperature $r_1$ within the allowable range.

On the other hand, if it is determined in step S37 that the target temperature $r_1$ is not lower than the lower limit temperature $T_{min}$ (NO), the method is ended.

Next, the case where it is determined in step S35 that the real humidity $H_{ca}$ is not lower than the lower limit humidity $H_{min}$ (NO) will be described.

In this case, the method proceeds to a subroutine B of step S39.

FIG. 9 is a flowchart illustrating the content of processing in the subroutine B.

In the subroutine B, the target temperature $r_1$ is lowered as much as possible within the allowable range in the following way.

First, in step S41, it is determined whether or not there is still room to further lower the real temperature $T_{ca}$ in the allowable range.

As mentioned above, the smallest unit of lowering the temperature is dT. Therefore, in this step, decision is made on whether or not there is still room to lower the real temperature $T_{ca}$, by determining whether or not $T_{ca}-dT$ is larger than the lower limit temperature $T_{min}$.

Here, when it is determined that $T_{ca}-dT$ is larger than the lower limit temperature $T_{min}$ (YES), it is decided that there is still room to lower the real temperature $T_{ca}$, and the method proceeds to step S42.

In step S42, the target temperature $r_1$ is lowered by changing the target temperature $r_1$ to $T_{ca}-dT$.

Then, the method proceeds to step S43, in which it is decided whether there is still room to further raise the real humidity $H_{ca}$ in the allowable range.

As mentioned above, the smallest unit of raising the humidity is dH. Therefore, in this step, decision is made on whether or not there is still room to raise the real humidity $H_{ca}$, by determining whether or not $H_{ca}+dH$ is smaller than the upper limit humidity $H_{max}$.

Here, when it is determined that $H_{ca}+dH$ is smaller than the upper limit humidity $H_{max}$ (YES), it is decided that there is still room to raise the real humidity $H_{ca}$, and the method proceeds to step S44.

In step S44, the target humidity $r_2$ is changed to $H_{ca}+dH$.

On the other hand, when it is determined in step S43 that $H_{ca}+dH$ is not smaller than the upper limit humidity $H_{max}$ (NO), there is no room to raise the real humidity $H_{ca}$.

Therefore, in this case, the method proceeds to step S45, in which the target humidity $r_2$ is set to the upper limit humidity $H_{max}$ so as to raise the humidity as much as possible within the allowable range.

Further, when it is determined in step S41 that $T_{ca}-dT$ is not larger than the lower limit temperature $T_{min}$ (NO), the method proceeds to step S46.

In this case, there is no room to lower the real temperature $T_{ca}$. Therefore, the target temperature $r_1$ and the target humidity $r_2$ are changed such that $r_1=T_{ca}$ and $r_2=H_{ca}$, so as to maintain the real temperature $T_{ca}$ and the real humidity $H_{ca}$ at their current values.

By the above operation, the basic steps of the method of changing the target temperature $r_1$ and the target humidity $r_2$ in the target value changing unit 34 end.

After that, the flowcharts in FIGS. 7 to 9 are repeated in the predetermined control cycle. Thus, each time step S42 in FIG. 9 is performed, the target temperature $r_1$ is lowered by dT, and hence the target temperature $r_1$ is changed to a temperature closer to the lower limit temperature $T_{min}$ than to the upper limit temperature $T_{max}$.

By lowering the target temperature $r_1$ as much as possible within a range within which the target temperature $r_1$ does not lower than the lower limit temperature $T_{min}$ in this manner, it is possible to efficiently cool the electronic apparatuses 14 with the cooling air C of the real temperature $T_{ca}$ which is low and close to the lower limit temperature $T_{min}$.

The inventor of this application conducted an examination to check whether the real temperature $T_{ca}$ of the cooling air C could be maintained at and around the lower limit temperature $T_{min}$. As a result, graphs in FIGS. 10A to 10C were obtained.

Figure 10A:
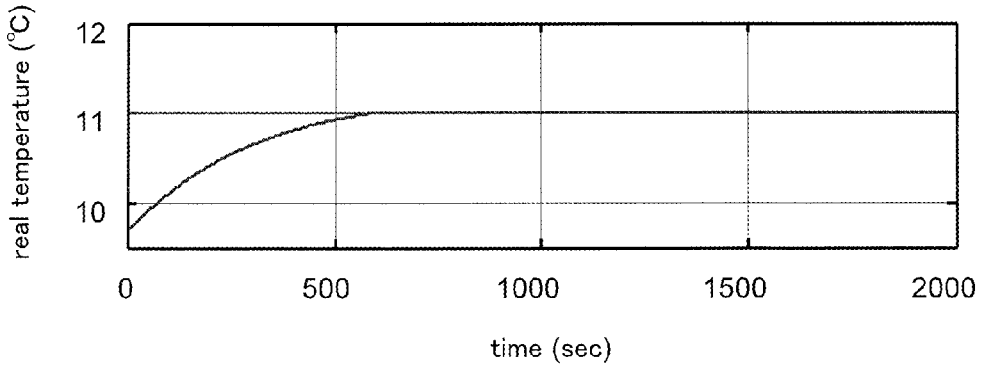
FIG. 10A is a graph obtained by studying the relationship between the time elapsed after start of the control on the damper, and the real temperature of the cooling air at the intake surface in this embodiment.

FIG. 10A is a graph obtained by studying the relationship between the time elapsed after start of the control of the damper 17, and the real temperature $T_{ca}$ of the cooling air C at the intake surface 14*x*.

Figure 10B:
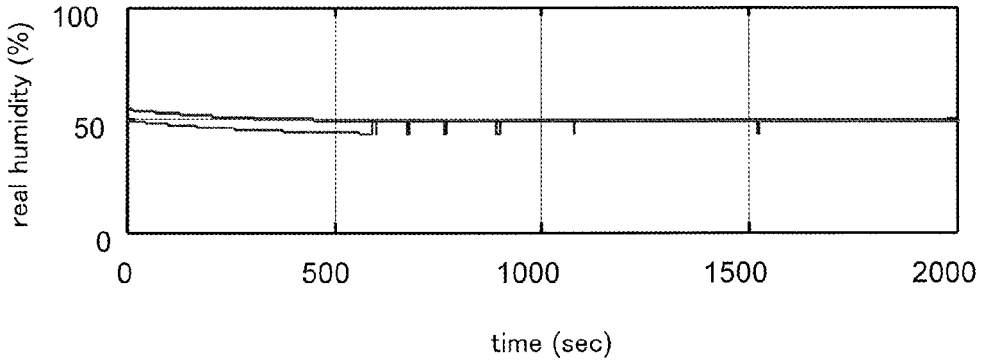
FIG. 10B is a graph obtained by studying the relationship between the elapsed time and the real humidity of the cooling air at the intake surface in this embodiment.

Moreover, FIG. 10B is a graph obtained by studying the relationship between the time elapsed after the start of the control of the damper 17, and the real humidity $H_{ca}$ of the cooling air C at the intake surface 14*x*.

Figure 10C:
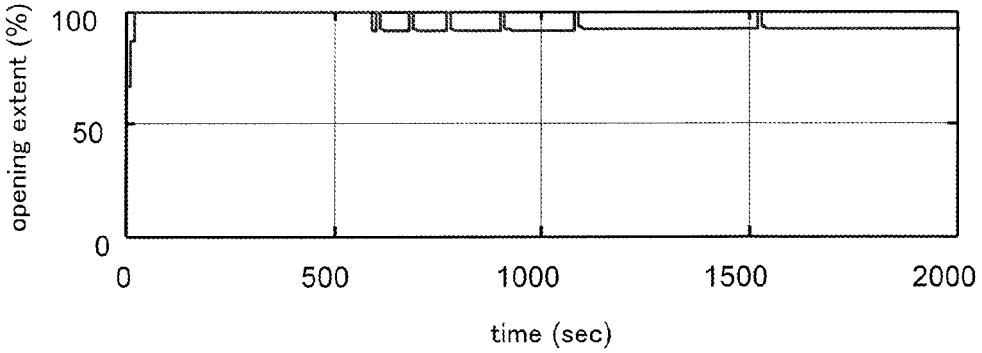
FIG. 10C is a graph obtained by studying the relationship between the elapsed time and the opening extent of the damper in this embodiment.

Furthermore, FIG. 10C is a graph obtained by studying the relationship between the time elapsed after the start of the control of the damper 17, and the opening extent of the damper 17.

In this examination, parameters were set as follows:

$T_{max0}=35°$ C.

$T_{min0}=10°$ C.

$H_{max0}=85\%$ $H_{min0}=10\%$ $dT=dH=1$ $T_{max}=T_{max0}-dT=34°$ C.

$T_{min}=T_{min0}+dT=11°$ C.

$H_{max}=H_{max0}-dH=84\%$ $H_{min}=H_{min0}+dH=11\%$.

As illustrated in FIG. 10A, the real temperature $T_{ca}$ was maintained at the lower limit temperature $T_{min}$ (11° C.). From this result, it was confirmed that the real temperature $T_{ca}$ of the cooling air C could be maintained at and around the lower limit temperature $T_{min}$ by following the flowchart in FIG. 9.

Moreover, in step S42 and step S44 mentioned above, the target temperature $r_1$ and the target humidity $r_2$ are changed such that the target temperature and the target humidity are raised and lowered in opposite directions each other. Since temperature and humidity have a negative correlation with each other, both the real temperature $T_{ca}$ and the real humidity $H_{ca}$ can be easily brought close to their target values $r_1$ and $r_2$ by raising and lowering these target values in the opposite directions in this manner.

According to this embodiment described above, in step S22 in FIG. 7, the target value changing unit 34 sets the target temperature $r_1$ and the target humidity $r_2$ such that the real temperature $T_{ca}$ and the real humidity $H_{ca}$ can be raised and lowered in the opposite directions. This is also the case in step S26, step S32, and step S36.

Thus, both the real temperature $T_{ca}$ and the real humidity $H_{ca}$ can be easily brought close to their target values as mentioned above.

Next, the inventor of this application conducted an examination on advantageous effects obtained by setting the target temperature $r_1$ and the target humidity $r_2$ such that the real temperature $T_{ca}$ and the real humidity $H_{ca}$ can be raised and lowered in the opposite directions as described above. As a result, graphs in FIGS. 11A and 11B were obtained.

Figure 11A:
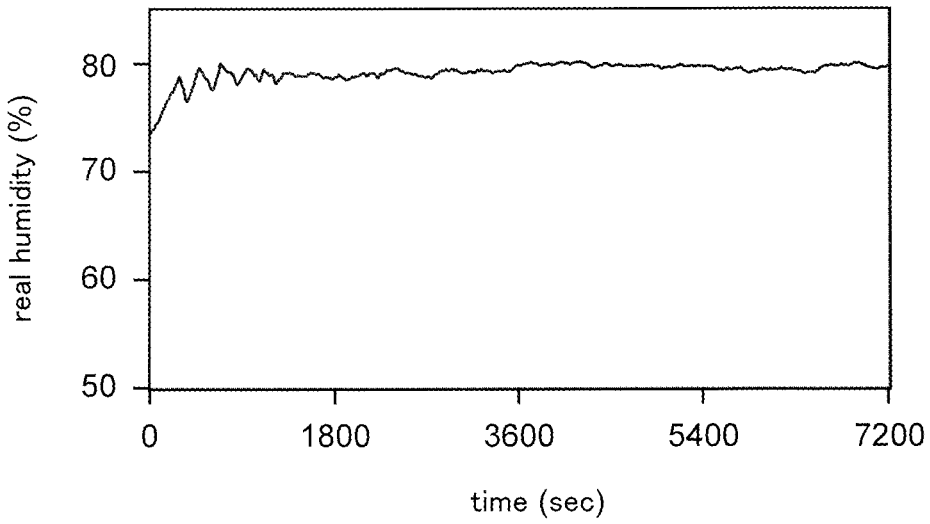
FIG. 11A is a graph obtained by studying the relationship between the time elapsed after start of the control on the damper, and the real humidity of the cooling air at the intake surface in this embodiment.

FIG. 11A is a graph obtained by studying the relationship between the time elapsed after the start of the control of the damper 17, and the real humidity $H_{ca}$ of the cooling air C at the intake surface 14*x*.

Figure 11B:
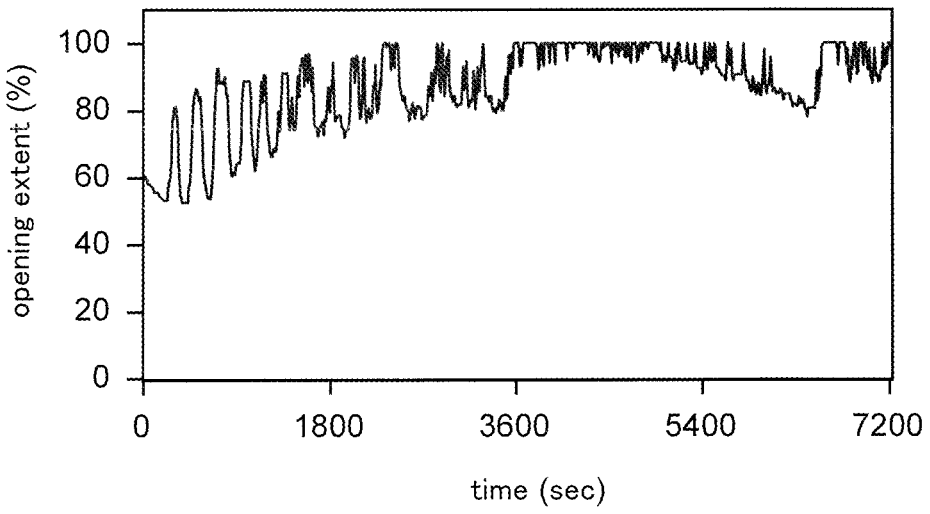
FIG. 11B is a graph obtained by studying the relationship between the elapsed time and the opening extent of the damper.

Moreover, FIG. 11B is a graph obtained by studying the relationship between the time elapsed after the start of the control of the damper 17, and the opening extent of the damper 17.

As illustrated in FIG. 11A, the real humidity H remained stable and did not largely fluctuate as in the case of FIG. 3A.

Moreover, as illustrated in FIG. 11B, no large fluctuations were observed in the opening extent of the damper 17, which indicates that any noticeable hunting phenomenon as that in FIG. 3B did not occur.

From these results, it was confirmed that the hunting phenomenon could be effectively suppressed by setting the target temperature $r_1$ and the target humidity $r_2$ such that the real temperature $T_{ca}$ and the real humidity $H_{ca}$ could be raised and lowered in the opposite directions as in this embodiment.

The reason for this is considered that, unlike the example of FIGS. 3A and 3B in which the switching between the temperature control mode and the humidity control mode is performed, the target temperature $r_1$ and the target humidity $r_2$ are changed as a whole in the present embodiment. Namely, in the present embodiment, the target temperature $r_1$ and the target humidity $r_2$ are raised and lowered in opposite directions each other in accordance with their negative correlation.

Since the hunting phenomenon of the damper 17 can be suppressed as described above, the power consumption of the damper 17 can be reduced, thereby making it possible to achieve energy saving of the datacenter 1.

Although the present embodiment is described above in detail, the present embodiment is not limited to the above.

For example, although the air conditioning control method for the datacenter 1 is described above, this embodiment may be applied to the air conditioning of facilities including heat generating parts.

REFERENCE EXAMPLE

In step S14 (see FIG. 5) of this embodiment, it is mentioned that the dimension n of the state variable x(k), the order $n_{d1}$ of the temperature prediction model, the dead times $d_{t1}$ and $d_{t2}$, and the order $n_{d2}$ of the humidity prediction model satisfy the relation $n=n_{d1}+d_{t1}+n_{d2}+d_{t2}$. The reason for this will be described below.

First, consider the state-space model of discrete time represented by the following equation (24). Note that the number of the input parameter and the output parameter of this model is one, and dimension of this model is one.

$$x(k+1)=Ax(k)+Bu(k)$$

$$y(k)=Cx(k)$$

$$A=[a]$$

$$B=[b]$$

$$C=[c]$$

$$x(0)=x_1(0) \tag{24}$$

Here, in the case where the dead time of an input u is 1 second and the cycle of k is 1 second, the model can be expressed such that, like the equation (25) given below, the value of the input u is stored in the second component of the state variable and shifted to the first row in the next cycle.

$$\begin{aligned} x(k+1) &= Ax(k) + Bu(k) \\ y(k) &= Cx(k) \\ x(0) &= \begin{bmatrix} x_1(0) \\ 0 \end{bmatrix}, A = \begin{bmatrix} a & b \\ 0 & 0 \end{bmatrix}, B = \begin{bmatrix} 0 \\ 1 \end{bmatrix}, C = [c]. \end{aligned} \tag{25}$$

In the example of the equation (25), the order of the state variable is 2, which is the sum of 1 as the model order and 1 as a value taking into consideration of the dead time.

Moreover, in the case where the dead time of the input u is 2 seconds, the model can be expressed such that, like the equation (26) given below, the second component and the third component of the state variable and the value of the input u are shifted, as in the above case.

$$\begin{aligned} x(k+1) &= Ax(k) + Bu(k) \\ y(k) &= Cx(k) \\ x(0) &= \begin{bmatrix} x_1(0) \\ 0 \\ 0 \end{bmatrix}, A = \begin{bmatrix} a & 0 & b \\ 0 & 0 & 0 \\ 0 & 1 & 0 \end{bmatrix}, B = \begin{bmatrix} 0 \\ 1 \\ 0 \end{bmatrix}, C = [c\ 0\ 0] \end{aligned} \tag{26}$$

In the example of the equation (26), the order of the state variable is 3, which is the sum of 1 as the model order and 2 as a value taking into consideration the dead time.

In the case where the dead time of the input u is 3 seconds, the model can be expressed such that, like the equation (27) given below, the second component, the third component, and the fourth component of the state variable and the value of the input u are shifted, as in the above cases.

$$\begin{aligned} x(k+1) &= Ax(k) + Bu(k) \\ y(k) &= Cx(k) \\ x(0) &= \begin{bmatrix} x_1(0) \\ 0 \\ 0 \\ 0 \end{bmatrix}, A = \begin{bmatrix} a & 0 & 0 & b \\ 0 & 0 & 0 & 0 \\ 0 & 1 & 0 & 0 \\ 0 & 0 & 1 & 0 \end{bmatrix}, B = \begin{bmatrix} 0 \\ 1 \\ 0 \\ 0 \end{bmatrix}, C = [c\ 0\ 0\ 0] \end{aligned} \tag{27}$$

In the example of the equation (27), the order of the state variable is 4, which is the sum of 1 as the model order and 3 as a value taking into consideration the dead time.

Next, consider the state-space model of discrete time represented by the following equation (28). Note that the number of the input parameter and the output parameter of this model is one, and dimension of this model is two.

$$x(k+1) = Ax(k) + Bu(k) \tag{28}$$

$$y(k) = Cx(k)$$

$$A = \begin{bmatrix} a_{11} & a_{12} \\ a_{21} & a_{22} \end{bmatrix}$$

$$B = \begin{bmatrix} b_1 \\ b_2 \end{bmatrix}$$

$$C = [c_1 \ c_2]$$

$$x(0) = \begin{bmatrix} x_1(0) \\ x_2(0) \end{bmatrix}$$

Here, in the case where the dead time of the input u is 1 second and the cycle of k is 1 second, the model can be expressed such that, like the equation (29) given below, the value of the input u is stored in the third component of the state variable and shifted to the first row and the second row in the next cycle.

$$x(k+1) = Ax(k) + Bu(k) \tag{29}$$

$$y(k) = Cx(k)$$

$$x(0) = \begin{bmatrix} x_1(0) \\ x_2(0) \\ 0 \end{bmatrix}, A = \begin{bmatrix} a_{11} & a_{12} & b_1 \\ a_{21} & a_{22} & b_2 \\ 0 & 0 & 0 \end{bmatrix}, B = \begin{bmatrix} 0 \\ 0 \\ 1 \end{bmatrix},$$

$$C = [c_1 \ c_2 \ 0]$$

Thus, the order of the state variable is 3, which is the sum of 2 as the model order and 1 as a value taking into consideration the dead time.

Moreover, in the case where the dead time of the input u is 2 seconds and the cycle of k is 1 second, the model can be expressed such that, like the equation (30) given below, the value of the input u is stored in the third component of the state variable, and further stored in the fourth component in the next cycle and then shifted to the first row and the second row.

$$x(k+1) = Ax(k) + Bu(k) \tag{30}$$

$$y(k) = Cx(k)$$

$$x(0) = \begin{bmatrix} x_1(0) \\ x_2(0) \\ 0 \\ 0 \end{bmatrix}, A = \begin{bmatrix} a_{11} & a_{12} & 0 & b_1 \\ a_{21} & a_{22} & 0 & b_2 \\ 0 & 0 & 0 & 0 \\ 0 & 0 & 1 & 0 \end{bmatrix}, B = \begin{bmatrix} 0 \\ 0 \\ 1 \\ 0 \end{bmatrix},$$

$$C = [c_1 \ c_2 \ 0 \ 0]$$

In the example of the equation (30), the order of the state variable is 4, which is the sum of 2 as the model order, and 2 as a value taking into consideration the dead time.

By the analogy with the above discussion, it is understood that the relation $n=n_{d1}+d_{t1}+n_{d2}+d_{t2}$ holds in the present embodiment.

All examples and conditional language provided herein are intended for the pedagogical purpose of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention has been described in detail, it should be understood that the various changes, substitutions, and alterations could be made hereto without departing from the spirit and scope of the invention.

What is claimed is:

1. An air conditioning control system, comprising:

an electronic apparatus having an intake surface from which cooling air is taken in and an exhaust surface from which the cooling air is discharged;

a flow path through which the cooling aft discharged from the exhaust surface is returned to the intake surface;

a damper which is provided in the flow path, an opening extent of the damper being adjustable;

a temperature sensor that measures a real temperature of the cooling air at the intake surface;

a humidity sensor that measures a real humidity of the cooling air at the intake surface;

a target value changer that changes a target temperature of the real temperature in accordance with a value of the real temperature, and also changes a target humidity of the real humidity in accordance with a value of the real humidity;

a controller that predicts a predicted temperature of the real temperature in a future and a predicted humidity of the real humidity in the future, where the controller controlling the opening extent of the damper such that the predicted temperature becomes close to the target temperature and the predicted humidity becomes close to the target humidity, wherein the target value changer is included in the controller, and the target value changer:

changes the target temperature to a predetermined upper limit temperature that is lower than the real temperature and changes the target humidity to a humidity that is higher than the real humidity when the real temperature is higher than the upper limit temperature, changes the target temperature to a predetermined lower limit temperature that is higher than the real temperature and changes the target humidity to a humidity that is lower than the real humidity when the real temperature is lower than the lower limit temperature, changes the target humidity to a predetermined upper limit humidity that is lower than the real humidity and changes the target temperature to a temperature that is higher than the real temperature when the real humidity is higher than the upper limit humidity, changes the target humidity to a predetermined lower limit humidity that is higher than the real humidity and changes the target temperature to a temperature that is lower than the real temperature when the real humidity is lower than the lower limit humidity, and changes the target temperature to a temperature that is lower than the real temperature and changes the target humidity to a humidity that is higher than the real humidity when the real temperature lies between the predetermined lower limit temperature and the predetermined upper limit temperature.

2. The air conditioning control method according to claim 1, wherein, the target value changer changes the target temperature to a temprature closer to the predetermined lower limit temperature than to the predetermined upper limit temperature when the real temperature lies between the predetermined lower limit temperature and the predetermined upper limit temperature.

3. The air conditioning control system according to claim 1, further comprising a predictor that predicts the predicted temperature and the predicted humidity based on the opening extent of the damper, wherein the predictor is included in the controller.

4. The air conditioning control system according to claim 3, wherein the predictor includes:

a prediction model that predicts the predicted temperature and the predicted humidity based on the opening extent of the damper;

a corrector that corrects the predicted temperature and the predicted humidity based on the real temperature and the real humidity;

a cost function that calculates a cost by weighting differences, the differences including a difference between the corrected predicted temperature and the target temperature, and the differences including a difference between the corrected predicted humidity and the target humidity; and an optimizer that calculates a manipulation amount in a predetermined period from a present to a future, the manipulation amount satisfying a predetermined constraint condition and also minimizing the cost.

5. An air conditioning control method, the method comprising:

measuring, by a temperature sensor, a real temperature of cooling air that is taken into an electronic apparatus from an intake surface of the electronic apparatus;

measuring, by a humidity sensor, a real humidity of the cooling air;

changing, by a target value changer, a target temperature of the real temperature in accordance with a value of the real temperature, and changing a target humidity of the real humidity in accordance with a value of the real humidity; and adjusting, by a controller, an opening extent of a damper provided in a flow path through which the cooling air discharged from an exhaust surface of the electronic apparatus is returned to the intake surface, where the opening extent being adjusted, by predicting a predicted temperature of the real temperature in a future and a predicted humidity of the humidity in the future, such that the predicted temperature becomes close to the target temperature and the predicted humidity becomes close to the target humidity, wherein the controller includes the target value changer, wherein in the changing the target temperature and the target humidity, the target value changer changes the target temperature to a predetermined upper limit temperature that is lower than the real temperature and changes the target humidity to a humidity that is higher than the real humidity when the real temperature is higher than the upper limit temperature, changes the target temperature to a predetermined lower limit temperature that is higher than the real temperature and changes the target humidity to a humidity that is lower than the real humidity when the real temperature is lower than the lower limit temperature, changes the target humidity to a predetermined upper limit humidity that is lower than the real humidity and changes the target temperature to a temperature that is higher than the real temperature when the real humidity is higher than the upper limit humidity, changes the target humidity to a predetermined lower limit humidity that is higher than the real humidity and changes the target temperature to a temperature that is lower than the real temperature when the real humidity is lower than the lower limit humidity, and changes the target temperature to a temperature that is lower than the real temperature and changes the target humidity to a humidity that is higher than the real humidity when the real temperature lies between the predetermined lower limit temperature and the predetermined upper limit temperature.

6. The aft conditioning control method according to claim 5, wherein, in the changing the target temperature and the target humidity, the target value changer changes the target temperature to a temperature closer to the predetermined lower limit temperature than to the predetermined upper limit temperature when the real temperature lies between the predetermined lower limit temperature and the predetermined upper limit temperature.

7. The air conditioning control method according to claim 5, wherein, in the adjusting the opening extent of the damper, a predictor predicts the predicted temperature and the predicted humidity based on the opening extent of the damper, wherein the predactor is included in the controller.

* * * * *